United States Patent [19]

Korenko

[11] 4,129,462

[45] Dec. 12, 1978

[54] GAMMA PRIME HARDENED NICKEL-IRON BASED SUPERALLOY

[75] Inventor: Michael K. Korenko, Richland, Wash.

[73] Assignee: The United States of America as represented by the United States Department of Energy, Washington, D.C.

[21] Appl. No.: 785,640

[22] Filed: Apr. 7, 1977

[51] Int. Cl.[2] ..... C22C 38/08

[52] U.S. Cl. ..... 148/31; 75/122; 75/124; 75/134 F; 176/88; 176/91 R

[58] Field of Search ..... 148/31; 75/124, 122, 75/134 F, 128 W, 128 R; 176/88, 91 R

[56] References Cited

U.S. PATENT DOCUMENTS

| | | | |
|---|---|---|---|
| 3,048,485 | 8/1962 | Bieber | 75/128 R |
| 3,300,347 | 1/1967 | Kasza et al. | 75/128 W |

*Primary Examiner*—R. Dean

*Attorney, Agent, or Firm*—Dean E. Carlson; Richard E. Constant; Ignacio Resendez

[57] ABSTRACT

A low swelling, gamma prime hardened nickel-iron base superalloy useful for fast reactor duct and cladding applications is described having from about 7.0 to about 10.5 weight percent (wt%) chromium, from about 24 to about 35 wt% nickel, from about 1.7 to about 2.5 wt% titanium, from about 0.3 to about 1.0 wt% aluminum, from about 2.0 to about 3.3 wt% molybdenum, from about 0.05 to about 1.0 wt% silicon, from about 0.03 to about 0.06 wt% carbon, a maximum of about 2 wt% manganese, and the balance iron.

4 Claims, 6 Drawing Figures

GAMMA PRIME HARDENED NICKEL-IRON BASED SUPERALLOY

This invention was made in the course of, or under, a contract with the Energy Research and Development Administration.

BACKGROUND OF INVENTION

The invention relates to a $\gamma'$ (gamma prime) hardened nickel-iron base superalloy.

Liquid metal fast breeder reactors have been designed to incorporate 20% cold worked 316 Series Stainless Steel (SS) for fuel cladding and duct applications. The National Alloy Development Program has as one of its goals the objective of finding materials that may be substituted for 20% cold worked 316 SS in these applications, which substitution materials will have greater resistance to swelling as well as improved strengths. It would be desirable to obtain alloys having these improved properties since they would result in a decreased cost in the power generation cycle as well as reduce the cost for spent fuel handling.

Gamma prime strengthening in stainless alloys is well known to the commercial superalloy industry. Materials such as A-286 and Nimonic PE16 typify this class of materials. A material for use in fuel cladding or duct applications in liquid metal fast breeder reactors has additional constraints and material requirements because of the unique and extreme nature of the neutron irradiation environment. A fuel cladding alloy, for example, will be exposed to flowing liquid sodium on the one side and nuclear fuel on the other side. The neutron irradiation introduces new and novel physical processes which can have a severe impact on the properties and behavior of the structural material. Neutron irradiation has an effect on, for example, the phenomenon of swelling in which the physical dimensions of an alloy will change due to the production of internal cavities, and the phenomenon of irradiation creep, in which an alloy will elastically deform under temperature and stress conditions which would not produce deformation without the irradiation environment. These special problems require special materials.

The liquid sodium environment, although potentially detrimental to many materials has one advantage that was utilized in the conception of the present invention. This advantage is that because of the chemical nature of liquid sodium and the low operating oxygen content of liquid sodium in reactors, it actually shields the materials from oxidation. This removes one restriction which is generally incorporated in normal nickel-iron based superalloys, i.e., the chromium content of those materials are generally higher, for example, in the range 15 to 19 wt%. This higher chromium protects the surface of the material from oxidation. Since materials immersed in liquid sodium in breeder reactors are not exposed to the harsh oxidation environment, lower chromium materials can be designed for reactor applications. The advantages of lower chromium materials include less tendency to form the detrimental sigma phase, potentially better fabricability, and potentially higher swelling resistance.

Low nickel alloys are more valuable than higher nickel materials for breeder applications since nickel has a relatively high neutron absorption cross section. This results in effectively wasted neutrons and reduced power production efficiency.

The alloys of this invention as described herein were designed by uniquely combining the gamma prime strengthening, solid solution strengthening, and silicon as a swelling inhibitor to the low chromium and low to intermediately low nickel range. The concept is contained in the unique combination of the above factors. The actual composition range can be improved somewhat by minimizing the potential phase instabilities commonly observed in nickel-iron superalloys, e.g., the G, sigma, mu, and Laves phases and by optimizing the titanium and aluminum contents and ratios. The titanium and aluminum optimization may be produced by the normal procedure of balancing the increased strength of high volume fractions of gamma prime phase against the decreased fabricability and weldability.

SUMMARY OF INVENTION

In view of the above, it is an object of this invention to provide a novel low swelling, nickel-iron superalloy, which is a solid solution strengthened alloy with gamma prime present for additional strengthening.

It is a further object of this invention to provide a novel nickel-iron superalloy useful for liquid metal breeder reactor duct and cladding applications.

It is a further object of this invention to provide a novel nickel-iron superalloy having improved void swelling properties.

It is a further object of this invention to provide a nickel-iron superalloy having a chromium concentration of from about 7.0 to about 10.5 wt% and a low nickel concentration of from about 24 wt% to about 35 wt%, said alloy having gamma prime phase present in the alloy matrix and being a stable alloy.

It is a further object of this invention to provide a nickel-iron superalloy having a high temperature strength comparable to 316 SS and improved swelling resistance over 316 SS at temperatures of from about 500° to about 700° C.

It is a further object of this invention to provide a material which possesses further strengthening by the gamma prime precipitate to utilize the incremental strengthening of this morphology.

Various other objects and advantages will appear from the following description of the invention and the most novel features will be pointed out hereinafter in connection with the appended claims. It will be understood that various changes in the details and composition of the alloy components which are herein described in order to explain the nature of the invention may be made by those skilled in the art without departing from the principles and scope of this invention.

The invention comprises a novel nickel-iron superalloy having the composition shown in Table I which is useful for liquid metal breeder reactor duct and cladding applications. The alloy of this invention has an improved strength comparable to 20% cold worked 316 SS at elevated temperatures of from about 300° to about 700° C., and has an improved swelling resistance under neutron fluence. The alloy of this invention swells approximately 30% or less than the amount of swelling of 316 SS.

DETAILED DESCRIPTION

Figure 1:
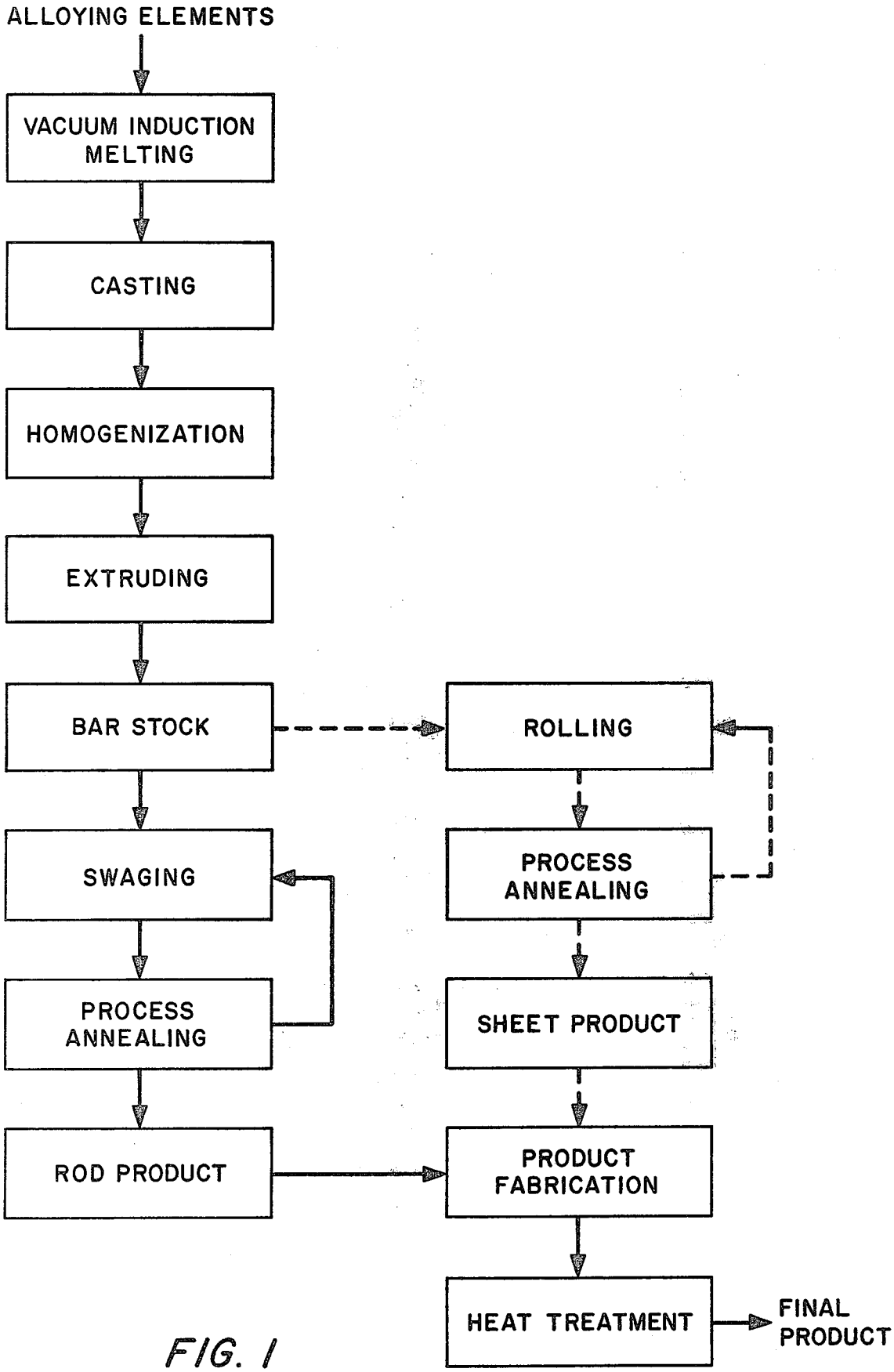
FIG. 1 outlines a flow process for obtaining the alloy of this invention.

FIG. 1 outlines a flow sequence that may be employed for arriving at the alloy of this invention having a general composition as shown in Table I.

TABLE I

| | Alloy Range* | E92* | E110* |
|---|---|---|---|
| Cr | 7.0-14 10.5 | 9.7 | 7.7 |
| Ni | 25-35 | 34.4 | 24.9 |
| Mo | 2.0-3.3 | 3.1 | 2.9 |
| Ti | 1.7-2.5 | 1.9 | 1.9 |
| Al | 0.3-1.0 | 0.5 | 0.5 |
| Si | 0.5-1.0 | 0.8 | 1.0 |
| C | 0.03-0.06 | 0.06 | 0.06 |
| Mn | 2.0 max. | 1.5 | 1.5 |
| Fe | Bal. | Bal. | Bal. |

*Alloy content expressed in weight percent.

TABLE II

TENSILE PROPERTIES OF PRECIPITATION STRENGTHENED NICKEL-IRON SUPERALLOY

| Alloy | Temp. (° C.) | 0.2% Yield Strength | Ultimate Tensile Strength | % Total Elongation |
|---|---|---|---|---|
| E110 | 650 | 78.4 | 89.7 | 10.5 |
| E110 | 650 | 79.4 | 92.1 | 12.3 |
| E92 | 650 | 79.8 | 100.3 | 11.1 |
| E92 | 650 | 78.9 | 96.6 | 12.6 |

This composition may contain incidental elements which are unavoidably included because they accompany the process of manufacturing the alloy or its elemental components. While maximum concentrations may be assigned to some of these impurities such as about 0.05 wt% nitrogen, about 0.005 wt% sulfur, and about 0.005 wt% phosphorus, these concentrations are preferably maintained as low as possible and it is desirable not to have these present in the alloy.

In addition, certain other elements may be added intentionally to provide a variety of improved properties. For example, boron may be added in a low concentration such as from about 0.003 to about 0.007 wt% to improve workability and stress rupture properties. Zirconium may be added in the same concentration range for similar reasons and for potential beneficial effects on swelling inhibition. Vanadium may be added for improved ductility in hot working or otherwise to improve notch ductility at elevated temperature. With the teaching of this invention which recites a concentration range for an alloy having improved resistance to swelling under a neutron fluence, one might wish to increase or decrease the content of some of the elements in order to provide improved characteristics. For example, one would expect to achieve strength increases by higher titanium and aluminum additions.

In making the alloy of this invention, the following procedure may be employed. Melting may be accomplished by adding the nickel, chromium, iron and molybdenum into a clean alumina crucible in a suitable furnace such as a vacuum induction furnace. It is understood that for different sized charges, times at temperature and other parameters would be altered within the skill of the art. The vacuum chamber may be evacuated to 10 μm (microns) of mercury and the charge melted and held at about 1650° C. for about 5 minutes. The charge is cooled to about 1540° C. and aluminum, carbon, titanium, manganese and silicon are added. The charge is then heated to about 1600° C. and held at temperature for about 1 minute and thereafter cooled to about 1510° C. and poured into mild steel molds with hot tops to form billets canned in mild steel.

The can dimension may be about 107 cm outer diameter, about 7.6 cm inner diameter and about 22 cm length. To make rod stock, these billets may be soaked at temperatures ranging from about 1066° C. to about 1204° C. for about 2 hours and thereafter extruded into 1.6 cm diameter bar stock using processes generally known in the art. The bar stock may be cut into 30.1 cm to 46 cm lengths and pickled to remove the mild steel can. The bars may then be swaged to 1.0 cm diameter and annealed in a hydrogen atmosphere at about 1093° C. for about one hour.

As an alternative, the rod stock may be rolled to suitable thickness sheet by heating to 900° C. and rolling to 50 percent reduction between process anneals of about 30 minutes at 900° C. The desired shape or configuration may then be fabricated from the rod or sheet material. Fabrication may be followed by a heat treatment process. It may be desired to solution treat and then age the fabricated item to achieve the desired properties, for example, by heating to from about 1000° C. to about 1100° C., holding at temperature for from about 15 minutes to about one hour, and subsequently air cooling. This solution treatment places the gamma prime phase and some of the carbonitrides into solution, and may be followed by heating to from about 875° to 925° C. for from 1 to 3 hours followed by air cooling to room temperature or furnace cooling to the next temperature. After this heating, the fabricated part may be heated to from about 675° C. to about 725° C. for from 6 to 24 hours and thereafter air or furnace cooled. This aging treatment precipitates gamma prime and achieves the optimum strength for the alloy.

If the alloy is to be used as a nuclear reactor component such as a fuel cladding, it may be desirable to use the solution treated fabricated part immediately after solution treatment. This will provide an alloy that has even less swelling, and the reactor environment will result in precipitation of the gamma prime and increase the strength of the alloy approximately to that achieved by the above aging treatments.

The chemical compositions of two alloys herein referred to as E92 and E110, which were made and produced by the above described process are given in Table I.

These specific compositions were subjected to hot tensile testing and elongation testing in accordance with the 1974 *ASTM Manual of Standards*, Part 10, ASTM Designation E21-70. For tensile testing, specimens having a total length of 6.35 cm (centimeters) and a reduced portion length of 1.9 cm were fabricated from 0.080 cm sheet.

Tensile testing was performed in a helium atmosphere with a 20,000 lb. Instron load frame. A calibrated platinum-platinum-rhodium thermocouple was used for temperature monitoring. Heatup time was approximately 10 minutes and a hold time of 20 minutes before start of test was used to assure proper temperature equilibration. Yield strain was taken from the chart output; final elongation was measured from graphite fiducial gage marks and pre- and post-test measurements. Pin holes and tabs were measured before and after testing for deformation. Deformation was not found in the tab; hole deformation was 0.008 cm or less.

Figure 2:
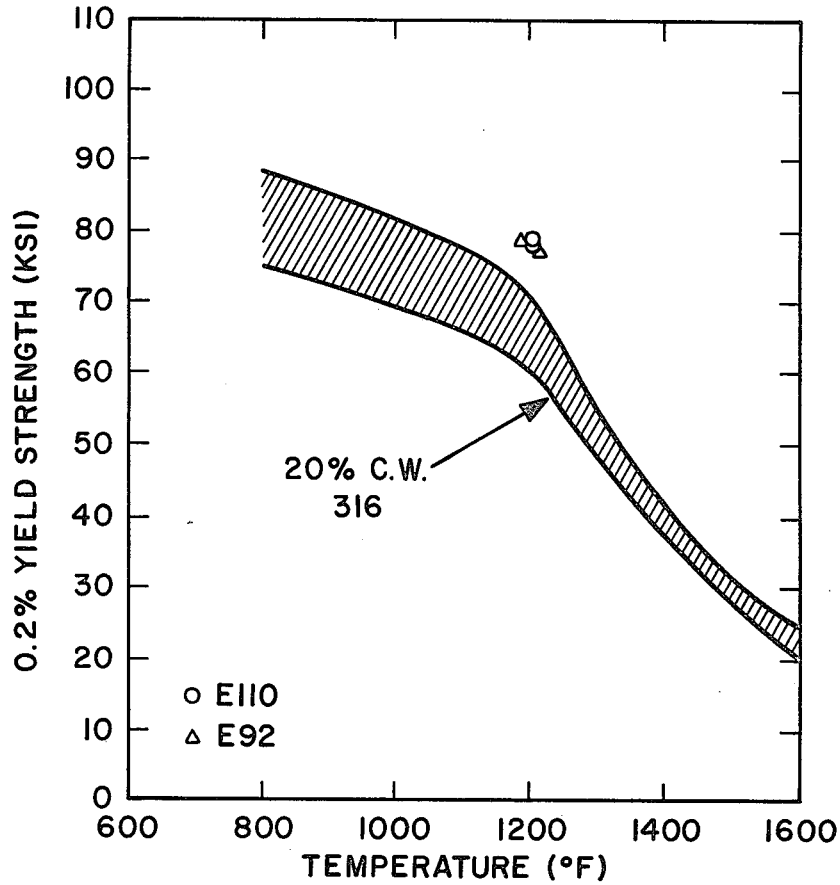
FIGS. 2, 3 and 4 provide yield strengths, ultimate tensile strengths and elongation values, respectively, for alloys of this invention.
Figure 3:
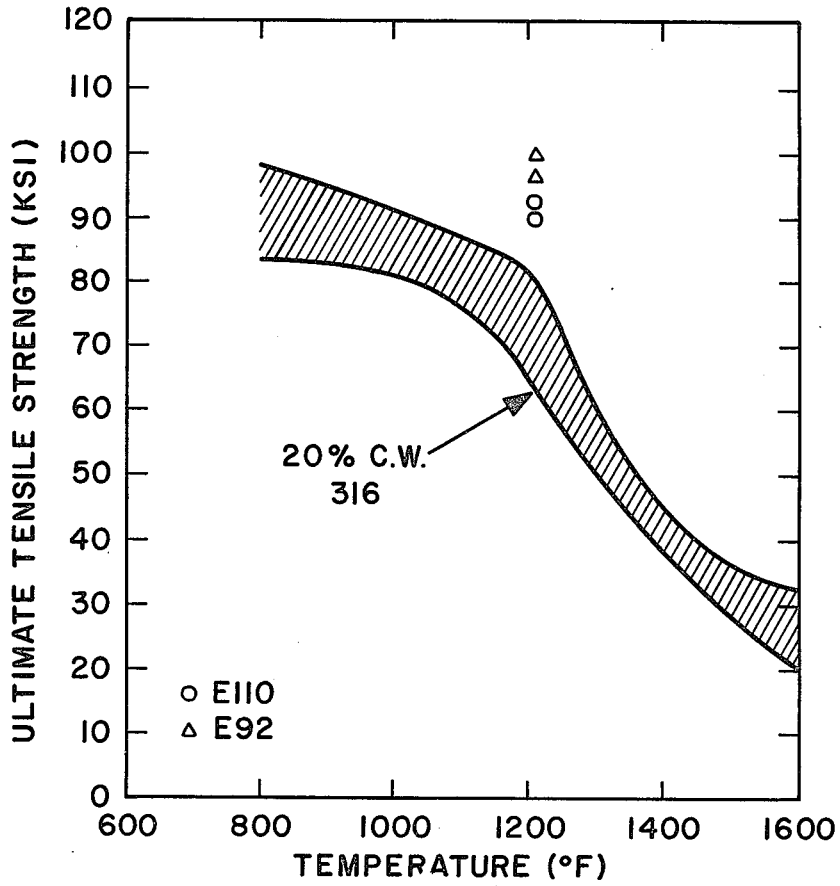
Figure 4:
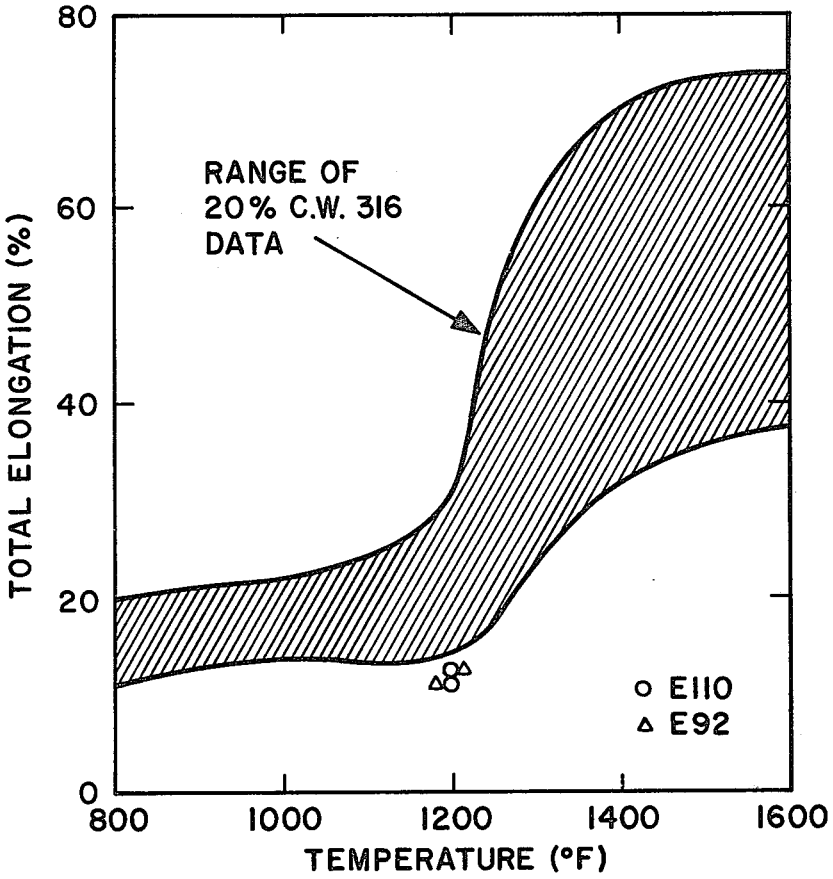

The results of these tensile tests are presented in FIGS. 2, 3, and 4 as well as in Table II. FIG. 2 correlates 0.2% yield strength at 650° C. for precipitation strengthened alloys E92 and E110. FIG. 3 correlates ultimate tensile strength at 650° C. for alloys E92 and E110. FIG. 4 correlates total elongation at 650° C. of alloys E92 and E110. The specific values are provided in Table II for the various test results. A scatter band for the tensile properties of 20% cold worked 316 SS is given for comparison on FIGS. 2, 3, and 4. For the alloy of this invention, the yield and ultimate strength are greater than 20% cold worked 316 SS while total elongation is slightly less.

In order to estimate the relative neutron absorption of the alloys under consideration, each elemental component of the alloy was assigned a neutron absorption cross-section as suggested by the spectral values in *Neutron Cross-Sections,* BNL-325, Third Edition, by S. F. Mughabghab and D. I. Garber, 1973, available from the National Technical Information Service in Springfield, Va. 22151. Alloy components were converted to atomic percents and an average neutron absorption cross-section was calculated for each alloy. The neutron absorption rating factor was calculated as a ratio of the calculated cross-section of 316 SS to that of the alloy in question. Densities were measured on all available materials and were incorporated in the calculation of the neutron absorption rating factor. These density corrections were necessary since candidate materials are compared with respect to a constant cladding thickness, not on the basis of a constant mass or a constant number of atoms.

In order to evaluate swelling, cylindrical specimens 0.66 cm long by 0.3 cm in diameter were irradiated in sodium-filled subcapsules in a reactor test to fluences of about $2 \times 10^{22}$ n/cm$^2$ (E > 0.1 MeV). After irradiation these specimens were removed, cleaned, identified and decontaminated to non-smearable levels. Immersion density measurements were repeated on each specimen until the densities could be specified to plus or minus 0.05%. The rod specimens were then recleaned, mounted and sawed into 0.03 cm thick disks which were subsequently electrolytically deburred and polished into transmission electron microscopy specimens. All examinations were made on the 1.0 MeV electron microscope.

Postirradiation examination of E92 and E110 indicated that these alloys swelled between 0.1 and 0.3% at the peak swelling temperature of 538° C. at a fluence of approximately $2 \times 10^{22}$ n/cm$^2$ (E ≧ 0.1 MeV). Alloy E110 displayed radiation-induced precipitation which suggests that its properties may be improved by a slight compositional modification, i.e., by lowering the molybdenum to near 1 wt% and the silicon to near 0.3 wt%. Both E92 and E110 are both probably in an incubation stage at the fluence level of $2 \times 10^{22}$ neutrons per square centimeter (n/cm$^2$) since this is a relatively low fluence. In alloy E110 the diffusion zones around the precipitates are still fairly localized and the gamma prime precipitates have not yet undergone extensive coarsening.

A comparison between the compositions of alloy E110 and alloy E92 will show that the primary differences are in the nickel contents. Thus, over the 24 to 35 wt% nickel range, the alloy can tolerate less molybdenum and silicon at the lower nickel end of the range. The high molybdenum content of alloy E110 in the lower nickel range will result in a greater tendency to produce topologically close packed precipitates or Laves precipitates. The acceptable ranges of molybdenum content vary with nickel content, i.e., at 25% nickel, 0.8 to 1.5% molybdenum is optimum whereas at the 35% range up to 3% molybdenum can be utilized.

Figure 5:
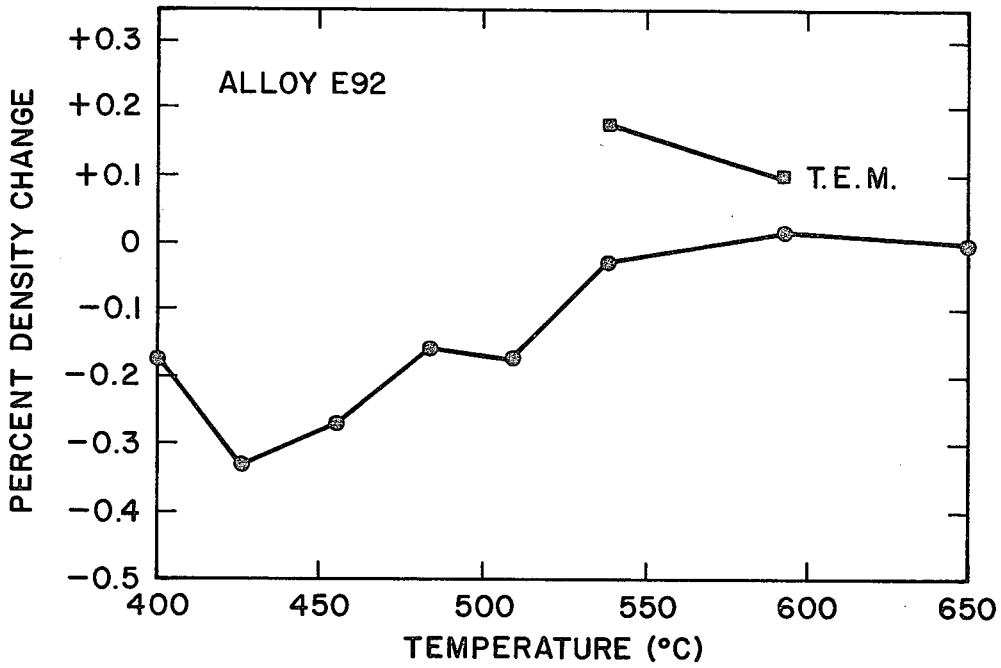
FIGS. 5 and 6 provide immersion density and transmission microscopy results for two alloys of this invention.

The results of the postirradiation immersion density and transmission electron microscopy (T.E.M.) analysis of alloy E92 are shown in FIG. 5. The peak temperature is, once again, 540° C. and the maximum swelling at the peak temperature is 0.18%. The gamma prime phase in alloy E92 proved to be very stable in that it redistributed extensively yet it did not transform to another phase such as eta phase. Gamma prime was deposited on dislocations, on pre-existing gamma prime, and on void surfaces. One of the early concerns regarding gamma prime-strengthened alloys was that gamma prime would dissolve away or coarsen too rapidly. Gamma prime redistribution behavior such as that exhibited by alloy E92 and the compositional range of this alloy of this invention, clearly indicate that these concerns do not have merit. In fact, the increased volume fraction of gamma prime and its finer distribution should strengthen the alloys in an irradiation environment.

Figure 6:
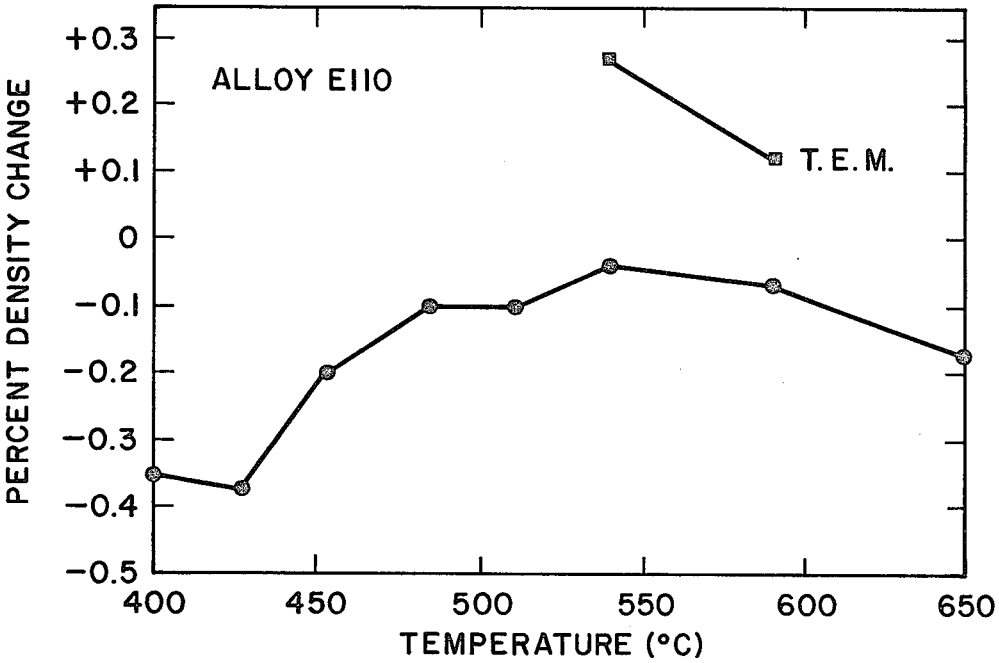

The results of the immersion density measurements as well as void swelling transmission electron microscopy results at 538° C. and 593° C. are illustrated in FIG. 6 for alloy E110. The peak swelling temperature for this material is 540° C. as indicated by both techniques. The 0.37% densification at 427° C. and the 0.2% difference between the void swelling determined by transmission microscopy analysis and that determined by the density change data are immediate indications of irradiation induced precipitation, which may be reduced by reducing the molybdenum content in this alloy.

This invention provides a novel alloy composition that is of superior strength to 20% cold worked 316 SS, is especially adaptable for use at high temperatures, and possesses excellent swelling resistance. The alloy of this composition will swell less than 20% at the goal fluence of $2.2 \times 10^{23}$n/cm$^2$ (E > 0.1 MeV).

What we claim is:

1. A gamma prime strengthened and solid solution hardened nickel-iron base alloy useful for fast reactor duct and cladding applications, the composition of said alloy imparting improved resistance to swelling in a neutron irradiation environment to said alloy, consisting essentially of from about 7.0 weight percent to about 10.5 weight percent chromium, from about 24 to about 35 weight percent nickel, from about 2.0 to about 3.3 weight percent molybdenum, from about 1.7 to about 2.5 weight percent titanium, from about 0.3 to about 1.0 weight percent aluminum, from about 0.5 to about 1 weight percent silicon, from about 0.03 to about 0.06 weight percent carbon, a maximum of about 2.0 weight percent manganese, and the balance iron, wherein said low chromium concentration range inhibits the formation of the detrimental sigma phase, and said silicon concentration range acts as a swelling inhibitor to the low chromium and low to intermediately low nickel range, which nickel composition range minimizes neutron absorption, and said molybdenum concentration range inhibits Laves phase precipitation induced by neutron irradiation, and wherein said alloy swells less than 0.3% at the peak swelling temperature of 538° C. at the fluence of $2.2 \times 10^{22}$ n/cm$^2$ (E > 0.1 MeV), and wherein said alloy exhibits an ultimate tensile strength in the range of about 90 to 100 ksi at 650° C.

2. The alloy of claim 1 consisting essentially of about 7.7 weight percent chromium, about 24.9 weight percent nickel, about 2.9 weight percent molybdenum, about 1.9 weight percent titanium, about 0.5 weight percent aluminum, about 1 weight percent silicon, about 0.06 weight percent carbon, about 1.5 weight percent manganese, and the balance iron.

3. The alloy of claim 1 consisting essentially of about 9.7 weight percent chromium, about 34.4 weight percent nickel, about 3.1 weight percent molybdenum, about 1.9 weight percent titanium, about 0.5 weight percent aluminum, about 0.8 weight percent silicon, about 0.06 weight percent carbon, and 1.5 weight percent manganese, and the balance iron.

4. The alloy of claim 1 wherein said alloy swells less than 20% at the goal fluence of $2.2 \times 10^{23}$ n/cm$^2$ (E > 0.1 MeV).

* * * * *